US006151994A

United States Patent [19]

Shiao

[11] Patent Number: 6,151,994

[45] Date of Patent: Nov. 28, 2000

[54] RATCHET SCREWDRIVER

[76] Inventor: Hsuan-Sen Shiao, No. 15-1, Lane 369, Min-Chuan Rd., Taichung City, Taiwan

[21] Appl. No.: 09/430,182

[22] Filed: Oct. 29, 1999

[51] Int. Cl.[7] ..... B25B 13/46

[52] U.S. Cl. ..... 81/61; 81/438

[58] Field of Search ..... 81/60–63.2, 438–439, 81/177.4

[56] References Cited

U.S. PATENT DOCUMENTS

| | | | |
|---|---|---|---|
| 5,875,692 | 3/1999 | Lin | 81/177.4 X |
| 5,964,132 | 10/1999 | Chen | 81/439 |
| 5,967,003 | 10/1999 | Lin | 81/60 X |
| 6,076,432 | 6/2000 | Chang | 81/61 |

*Primary Examiner*—D. S. Meislin
*Attorney, Agent, or Firm*—Foley & Lardner

[57] ABSTRACT

A ratchet screwdriver includes a handle defining a ratchet shaft receiving hole therethrough, and a ratchet shaft disposed therein. The ratchet shaft has a ratchet wheel mounted securely between first and second end portions, and an engaging unit between the ratchet shaft and a drive shaft inserted in the first or second end portions to prevent axial displacement and permit co-rotation thereof. A ratchet housing includes a coupling portion sleeved on the ratchet shaft and coupled to the handle for co-rotation therewith, a wheel confining portion defining a cavity enclosing the ratchet wheel, and a shoulder between the coupling and wheel confining portions. The wheel confining portion is formed with a pawl retaining groove in communication with the cavity to receive a pawl member which is mounted pivotally on the shoulder and which extends radially into the cavity. A biasing member biases the pawl member to mesh with the ratchet wheel such that when the handle is driven in a counterclockwise direction, the ratchet and the drive shafts correspondingly rotate in the counterclockwise direction. The handle is turned 180 degrees along a radial line to reverse positions of the first and second end portions of the ratchet shaft to permit rotation of the handle in the clockwise direction.

3 Claims, 10 Drawing Sheets

RATCHET SCREWDRIVER

BACKGROUND OF THE INVENTION

1. Field of the Invention

The present invention relates to a ratchet screwdriver, more particularly to a ratchet screwdriver which has a relatively simple structure and which permits operation and replacement of tool bits mounted on two opposite ends of the drive shaft of the ratchet screwdriver.

2. Background of the Invention

FIG. 1 illustrates a first conventional ratchet screwdriver which has a hollow handle 10 formed with an axial receiving chamber 11 with open front and rear ends. An inner coupling sleeve 12 is received in the axial receiving chamber 11 adjacent to the rear end, while an outer coupling sleeve 13 is extended into the axial receiving chamber 11 and is disposed at the front end. The inner coupling sleeve 12 has a first section confining a rectangular hole portion 122 with a rectangular cross-section, and a second section confining a hexagonal hole portion 121 which has a hexagonal cross-section and which is connected to the rectangular hole portion 122. The outer coupling sleeve 13 confines an axial hole 131. A ratchet assembly 15 is mounted on the rear end of the handle 10, and has one end provided with a drive projection 151 which has a rectangular cross-section and which engages the rectangular hole portion 122, and the other end provided with a turning wheel 152 which extends out of the handle 10. A drive shaft 16 is extended through the axial hole 131 and into the axial receiving chamber 11 of the handle 10, and is retained in the axial hole 131 by an annular spring 132 provided on an inner surface of the outer coupling sleeve 13. The drive shaft 16 has two opposite ends, each of which engages a tool bit 161 that has a shank portion with a hexagonal cross-section. The shank portion of one of the tool bits 161 extends into the hexagonal hole portion 121 in the inner coupling sleeve 12, and engages non-rotatably the inner coupling sleeve 12. When the handle 10 is rotated in a certain direction, since the drive projection 151 engages the inner coupling sleeve 12, the inner coupling sleeve 12 engages one of the tool bits 161, and said one of the tool bits 161 engages the drive shaft 16, the drive shaft 16 is rotated axially which in turn cause rotation of another one the tool bits 161 in order to operate a workpiece, such as a screw. However, when the screwdriver applies a forward driving force along the drive shaft 16 during rotation, it is likely that the drive shaft 16 pushes the inner coupling sleeve 12 rearwardly so as to push the ratchet assembly 15 outwardly of the handle 10. In this situation, the inner coupling sleeve 12 and one of the tool bits 161 might be undesirably exposed to injure the user.

Referring to FIGS. 2 and 3, another conventional ratchet screwdriver is shown to include a handle 20 having a head portion 21 which is formed with an axial hole 217 with an open end, and a slot 211. An actuator 221 and a pair of pawl plates 222 are disposed in the slot 211. A tubular housing 23 is sleeved around the headportion 21, and is formed with a circumferentially extending slot 231 to permit extension of an operating protrusion 223 of the actuator 221 therethrough. A drive shaft 24 is extended into the axial hole 217 in the head portion 21. The drive shaft 24 has two opposite ends formed with an axial blind hole 243 for engaging a tool bit 25, and an intermediate portion formed as a ratchet wheel 241. A pair of annular retaining grooves 242 are formed on opposite sides of the ratchet wheel 241 for engaging ball members 215 which are mounted on the head portion 21 and which are biased radially and inwardly by means of springs 216 to engage the annular groove 242, thereby retaining the drive shaft 24 on the head portion 21. As shown, the actuator 221 is operable to move in a direction transverse to an axis of the drive shaft 24 to engage a selected one of the pawl plates 222 with the ratchet wheel 241 such that the drive shaft 24 can be driven by rotating the handle 20 in a certain direction.

However, this type of ratchet screwdriver suffers from the following drawbacks: when the drive shaft 24 is inserted into the axial hole 217 of the handle 20, the pawl plates 222 will be pushed by an end wall of the drive shaft 24. In case the drive shaft 24 is frequently inserted into and removed from the handle 20 for replacement of the tool bits 25, the pawl plates 222 are susceptible to deformation and displacement, thereby affecting adversely the engagement between the pawl plates 222 and the ratchet wheel 241.

SUMMARY OF THE INVENTION

Therefore, the object of the present invention is to provide a ratchet screwdriver which can solve the aforementioned problems.

Accordingly, the ratchet screwdriver according to the present invention includes a plurality of tool bits, an elongated handle, a drive shaft, and a ratchet assembly. Each of the tool bits has an intermediate shank portion with a non-circular cross-section, and two bit portions at opposite ends of the intermediate portion and being designed to have different configurations for driving different workpieces. The handle has front and rear parts opposite to each other in an axial direction and a juncture therebetween which define a juncture line radial to the axial direction, and the front and rear parts cooperating with each other to define a ratchet shaft receiving hole therethrough. The drive shaft includes a cylindrical shaft portion with two opposite ends, each being formed with an axially extending bit engaging hole of a non-circular cross-section to receive the intermediate shank portion of a respective one of the tool bits so as to expose the bit portion of the respective one of the tool bits outwardly from the bit engaging hole. The ratchet assembly includes a cylindrical ratchet shaft disposed rotatably in the ratchet shaft receiving hole, and having a circumferential wall with opposite first and second end portions to permit extension of the drive shaft, thereby exposing the bit engaging hole of the drive shaft outwardly from the handle when the drive shaft is inserted into the circumferential wall via the first end portion, and a ratchet wheel mounted securely thereon between the first and second end portions. An engaging unit is interposed between the ratchet shaft and the drive shaft for preventing axial displacement relative to each other and permitting co-rotation together. A ratchet housing includes a coupling portion sleeved on the ratchet shaft and coupled with at least one of the front and rear parts so as to be co-rotatable axially therewith, a wheel confining portion that extends from the coupling portion and that defines a cavity to enclose the ratchet wheel therein, and a mounting shoulder between the coupling portion and the wheel confining portion and abutting against a front side of the ratchet wheel. The wheel confining portion is further formed with an axially extending pawl retaining groove in communication with the cavity. A pawl member is disposed in the pawl retention groove, and has a pivot portion mounted pivotally on the mounting shoulder and an engaging portion that extends integrally and radially from the pivot portion into the cavity. A biasing member biases the pawl member and urges the engaging portion to mesh constantly with the ratchet wheel such that when the handle is driven in a counterclockwise direction, the ratchet shaft and the drive shaft correspondingly rotate in the counterclockwise direction. When the handle is turned around the juncture line by 180 degrees to have the positions of the front and rear parts reversed, and the drive shaft is removed from the first end portion and subsequently inserted into the second end portion of the ratchet shaft, rotation of the handle in a clockwise direction will drive the drive shaft in the clockwise direction.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
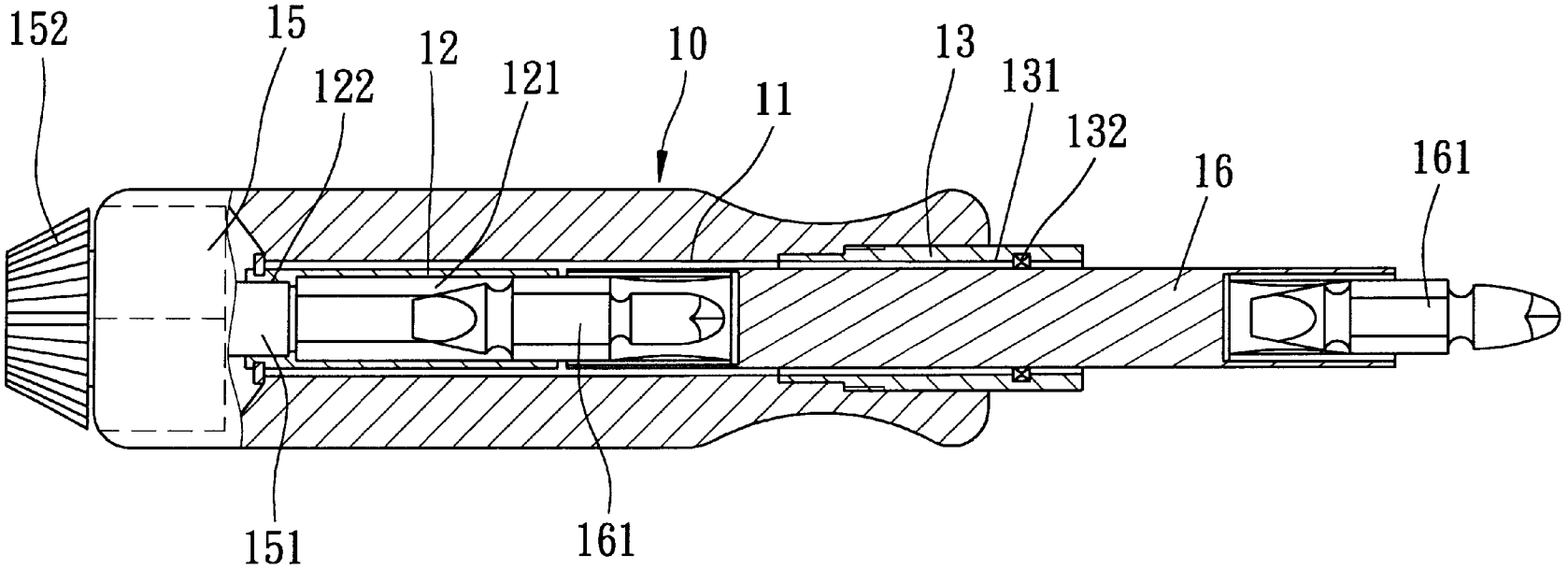
FIG. 1 PRIOR ART
FIG. 1 is a fragmentary and sectional view of a first conventional ratchet screwdriver.
Figure 2:
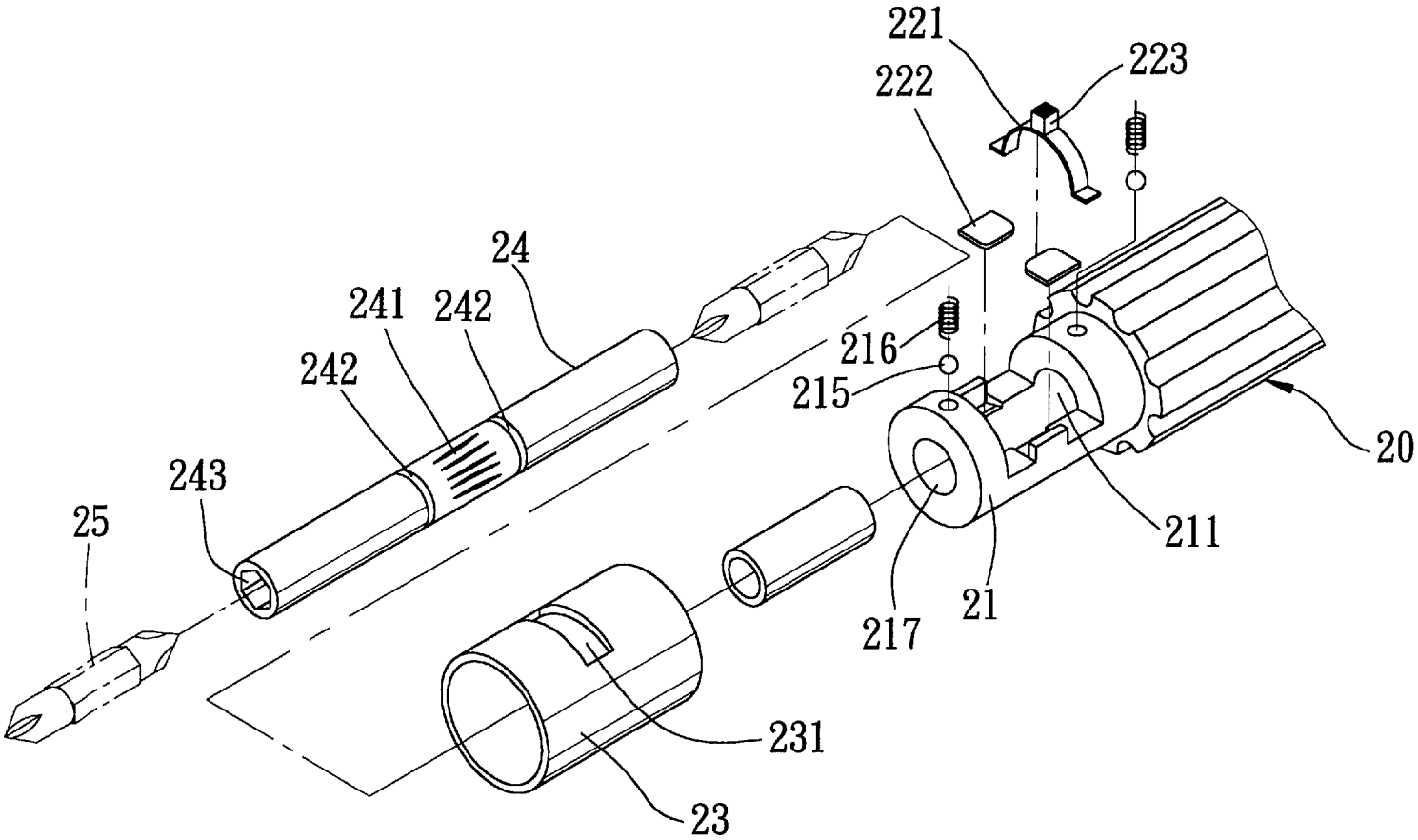
FIG. 2 PRIOR ART
FIG. 2 is a partial exploded view of a second conventional ratchet screwdriver.
Figure 3:
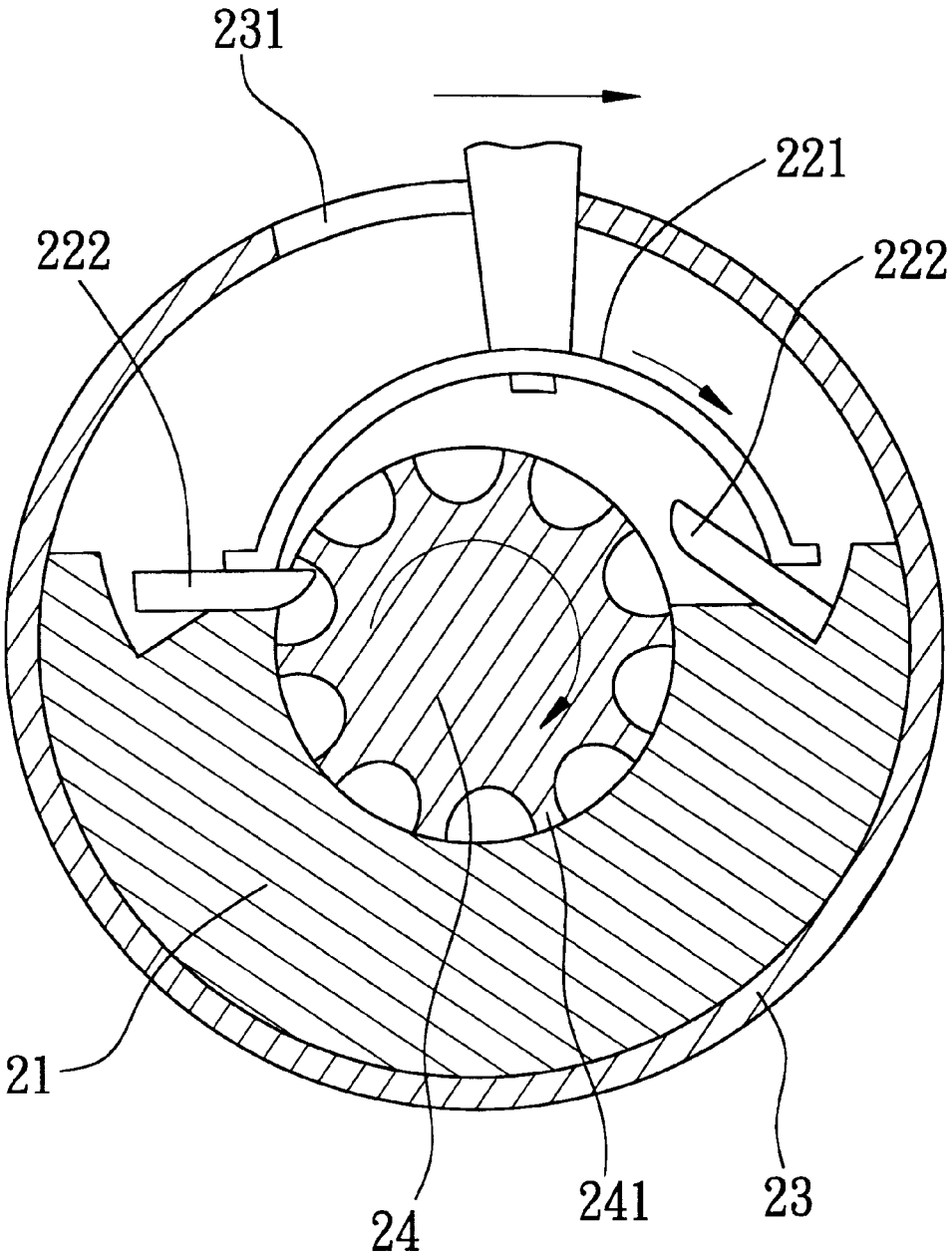
FIG. 3 PRIOR ART
FIG. 3 is a cross-sectional view of the second conventional ratchet screwdriver.

Before the present invention is described in greater detail, it should be noted that like elements are denoted by the same reference numerals throughout the disclosure.

Figure 4:
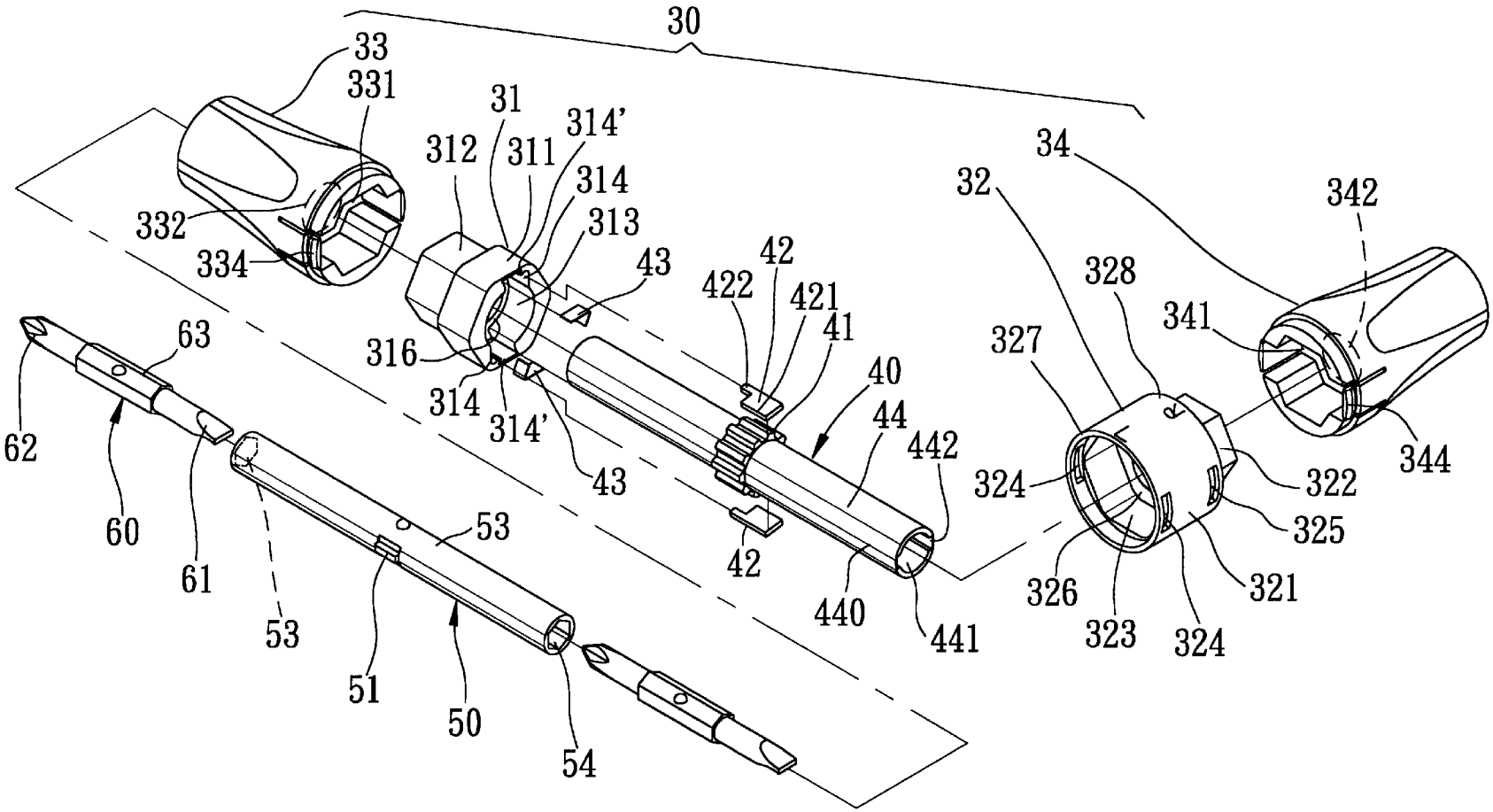
FIG. 4 is an exploded view of the preferred embodiment of a ratchet screwdriver according to the present invention.
Figure 5:
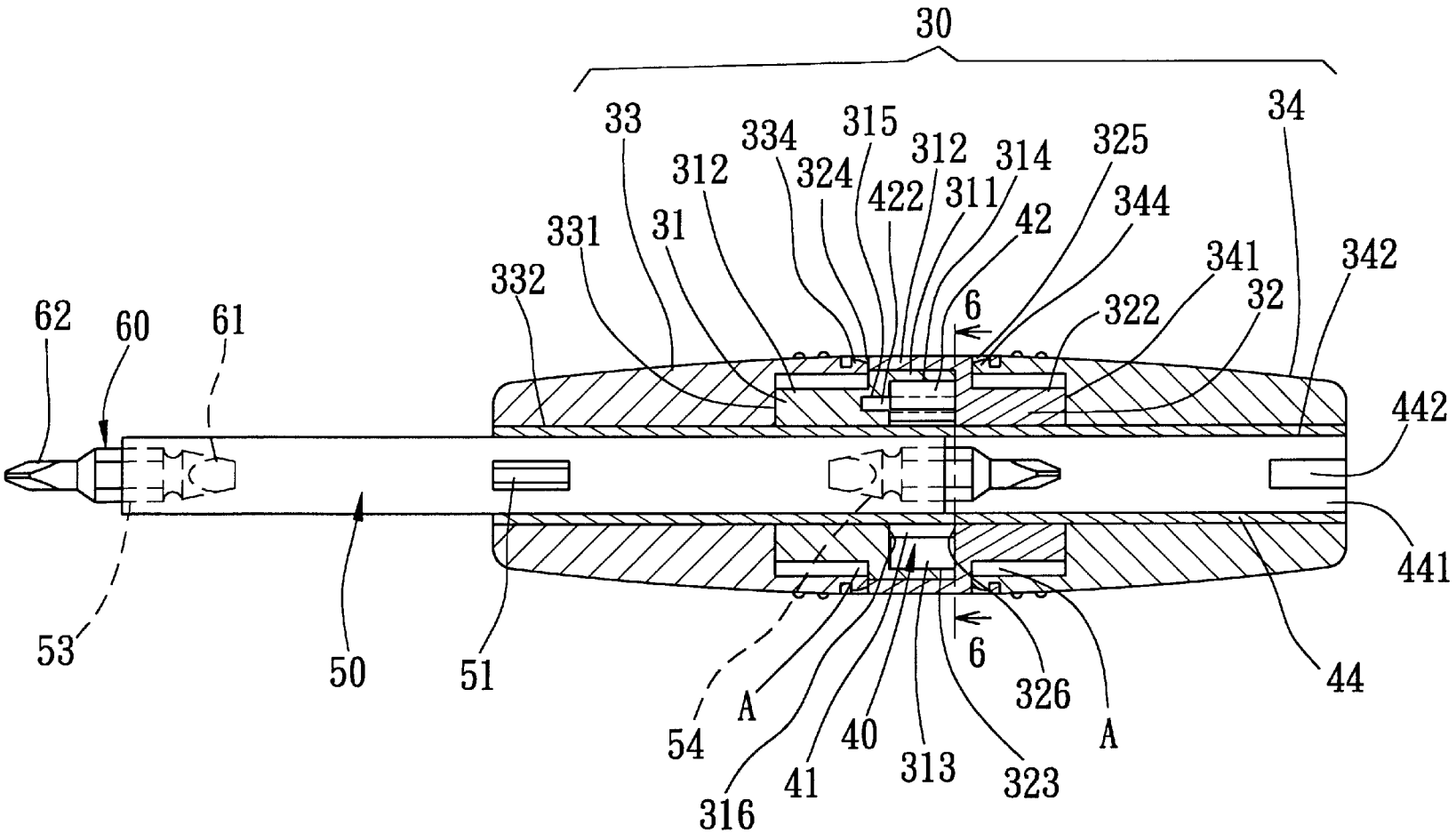
FIG. 5 is a partial sectional view of the preferred embodiment when turned in a clockwise direction in use.
Figure 6:
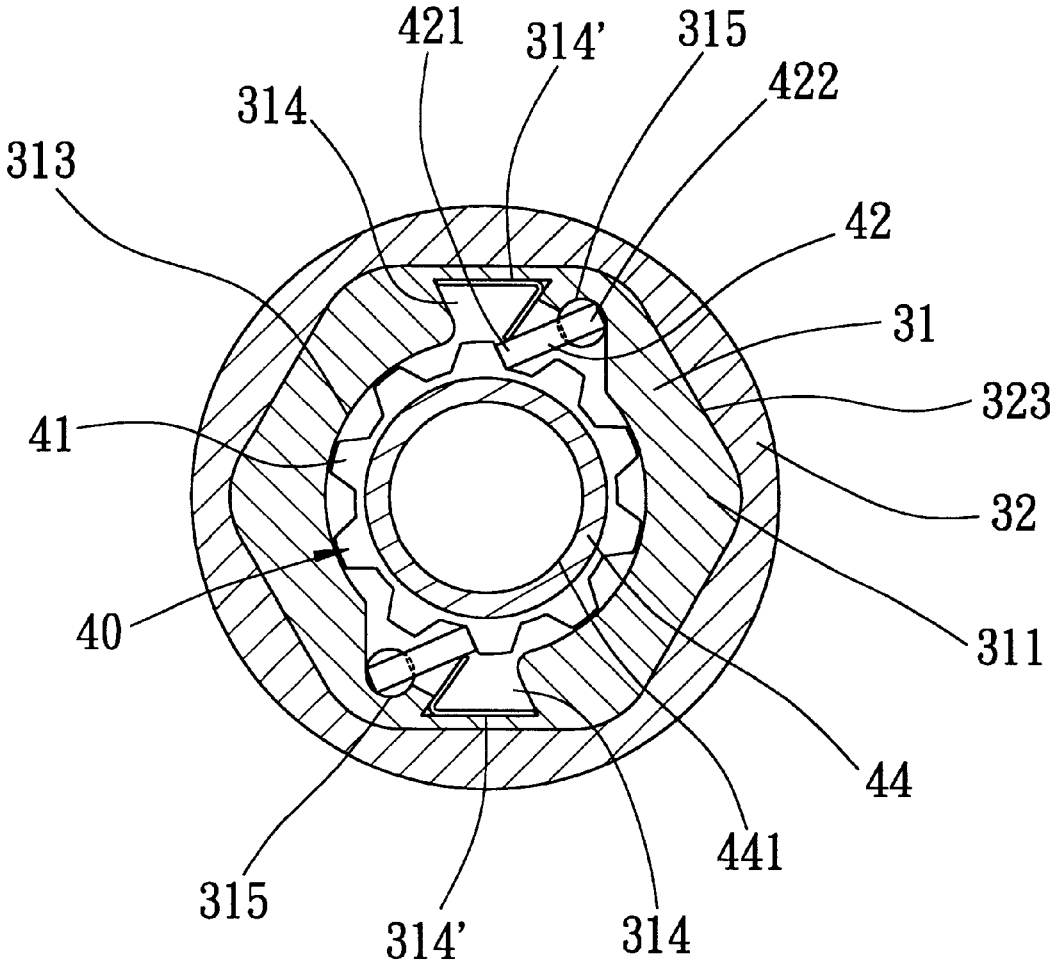
FIG. 6 is a cross-sectional view of the preferred embodiment taken along lines 6—6 of FIG. 5.

Referring to FIGS. 4, 5 and 6, a preferred embodiment of a ratchet screwdriver according to the present invention is shown to include a plurality of tool bits 60, an elongated handle 30, a drive shaft 50, and a ratchet assembly 40.

As illustrated, each of the tool bits 60 has an intermediate shank portion 63 with a hexagonal cross-section, and two bit portions 61,62 formed on two opposite ends of the shank portion 63. Preferably, the bit portions 61, 62 of the tool bits 60 are designed to have different configurations for driving different types of workpieces.

The handle 30 has front and rear parts 33,34 opposite to each other in an axial direction and a juncture therebetween which define a juncture line radial to the axial direction. The front and rear parts 33,34 cooperate with each other to define a ratchet shaft receiving hole (332,342) therethrough.

The drive shaft 50 includes a cylindrical shaft portion 53 with two opposite ends 53,54 which are formed with axially extending bit engaging holes of hexagonal cross-sections respectively to receive the intermediate shank portions 63 of respective ones of the tool bits 60 so as to expose the bit portions 61,62 of the respective tool bits 60 outwardly from the bit engaging holes.

The ratchet assembly 40 includes a cylindrical ratchet shaft 44, engaging means, a ratchet housing 31, two pawl members 42, and two biasing members 43. The cylindrical shaft 44 is disposed rotatably in the ratchet shaft receiving hole (332,342), and has a circumferential wall 440 with opposite first and second end portions 441 to permit extension of the drive shaft 50 so as to expose at least one of the bit engaging hole of the drive shaft 50 outwardly of the handle 30 when the drive shaft 50 is inserted into the circumferential wall 440 via the first end portion 441, and a ratchet wheel 41 mounted securely and integrally thereon between the first and second end portions 441.

The engaging means is interposed between the ratchet shaft 44 and the drive shaft 50 for preventing axial displacement relative to each other and permitting co-rotation together. The engaging means utilized in the preferred embodiment includes a spaced pair of axially extending key projections 51 disposed on the cylindrical shaft portion 53, and two spaced pairs of axially extending projection engaging grooves 442 formed in the first and second end portions 441 of the ratchet shaft 44 for engaging the key projections 51.

The ratchet housing 31 includes a coupling portion 312 with a first outer circumferential wall and sleeved around the ratchet shaft 44 and coupled with at least one of the front and rear parts 33,34 so as to be co-rotatable axially therewith, a wheel confining portion 311 that extends from the coupling portion 312 and that defines a cavity 313 enclosing the ratchet wheel 41 therein, and a mounting shoulder 316 between the coupling portion 312 and the wheel confining portion 311 to abut against a front side of the ratchet wheel 41. The wheel confining portion 311 further has two axially extending pawl retaining grooves 314 disposed at two diametric positions thereof and in communication with the cavity 313.

Each of the pawl members 42 is disposed in a respective one of the retention grooves 314, and has a pivot portion 422 rotatably mounted in the pivot hole 315 (see FIG. 6) formed on the mounting shoulder 316 and an engaging portion 421 that extends integrally and radially from the pivot portion 422 into the cavity 313.

Each of the two biasing member 43 is disposed to bias the pawl member 42 and urges the engaging portion 421 to mesh constantly with the ratchet wheel 41 such that when the handle 30 is driven in a counterclockwise direction, the ratchet shaft 44 and the drive shaft 50 correspondingly rotate in the counterclockwise direction, as best shown in FIG. 5. The biasing members 43 are V-shaped leaf springs. Preferably, the wheel confining portion 311 is further formed with a pair of dovetail grooves 314' respectively adjacent to the pawl retaining grooves 314 and in communication with the cavity 313 such that as the biasing members 43 are disposed therein, the biasing members 43 bias the pawl members 42 to mesh with the ratchet wheel 41.

Referring again to FIG. 4, the handle 30 includes an intermediate part 32 interposed between the front and rear parts 33,34. The intermediate part 32 includes a small-diameter section 322 with a second outer circumferential wall of a hexagonal cross-section which corresponds to the first outer circumferential wall of the coupling portion 312, a large-diameter section 321 which confines a first inner circumferential wall 323 and is sleeved on the wheel confining portion 311 of the ratchet housing 31, an abutment shoulder 326 between the large and small-diameter sections 321,322 and abutting against a rear side of the ratchet wheel 41, annular front and rear engaging portions 327,328 disposed integrally at two opposite ends of the large-diameter section 321 such that the front and rear engaging portions

327,328 are diametrically spaced from the first and second outer circumferential walls, respectively, to define a front annular receiving space between the front engaging portion 327 and the first outer circumferential wall and a rear annular receiving space between the rear engaging portion 328 and the second outer circumferential wall, and two pairs of diametrically disposed engagement slots 324,325 formed through the front and rear engaging portions 327,328. Each of the front and rear parts 33,34 further has a mating portion 331,341 confining a second inner circumferential wall 323 of a hexagonal cross-section which corresponds to the first and second outer circumferential walls of the coupling portion 312 and the small-diameter section 322, and a spaced pair of resilient engaging tongues 334,344 that extend axially from the mating portion 331,341 so as to be brought axially and coupled to the intermediate part 32 with the engaging tongues 334,344 engaging the engaging slots 324,325.

Figure 7:
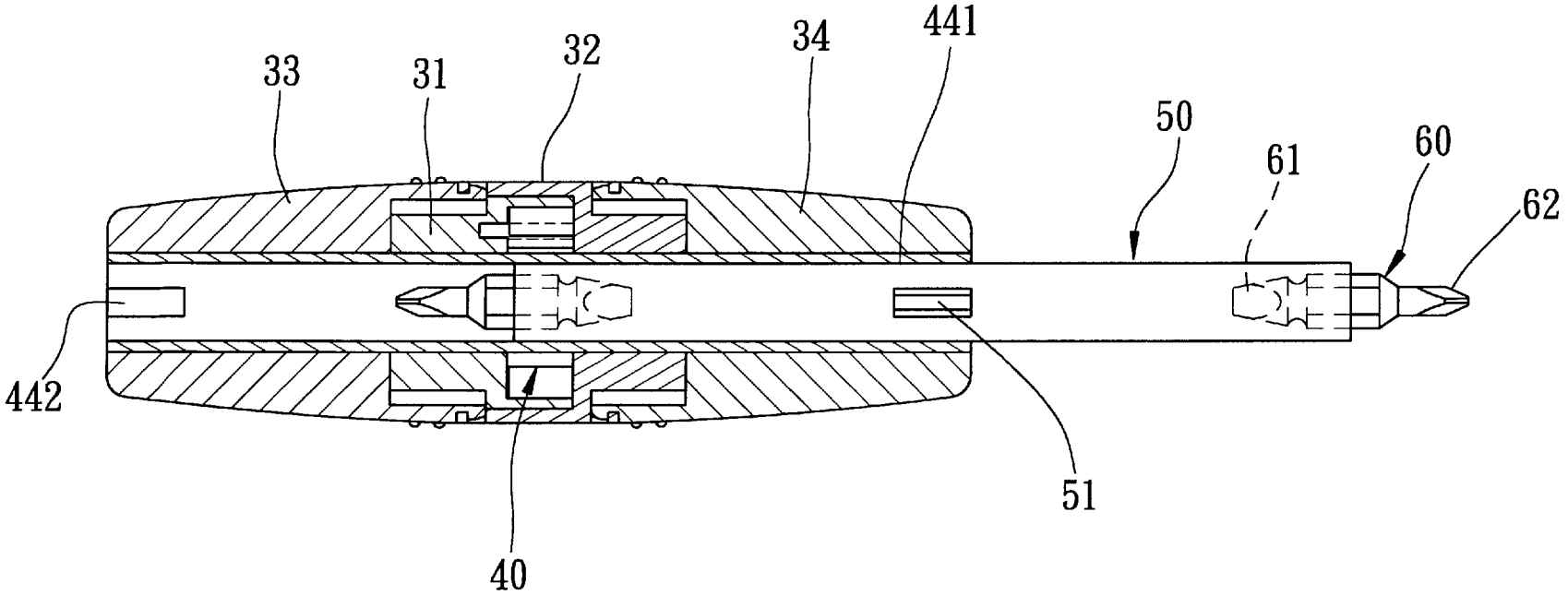
FIG. 7 is a partial sectional view of the preferred embodiment when turned in a counterclockwise direction in use.

Referring to FIG. 7, once the drive shaft 50 has been turned around the juncture line by 180 degrees to have the positions of the front and rear parts 33,34 reversed, and the drive shaft 50 is removed from the first end portion 441 and subsequently inserted into the second end portion 441 of the ratchet shaft 44, rotation of the handle 30 in a clockwise direction will accordingly drive the drive shaft 50 to rotate in the clockwise direction.

Figure 8:
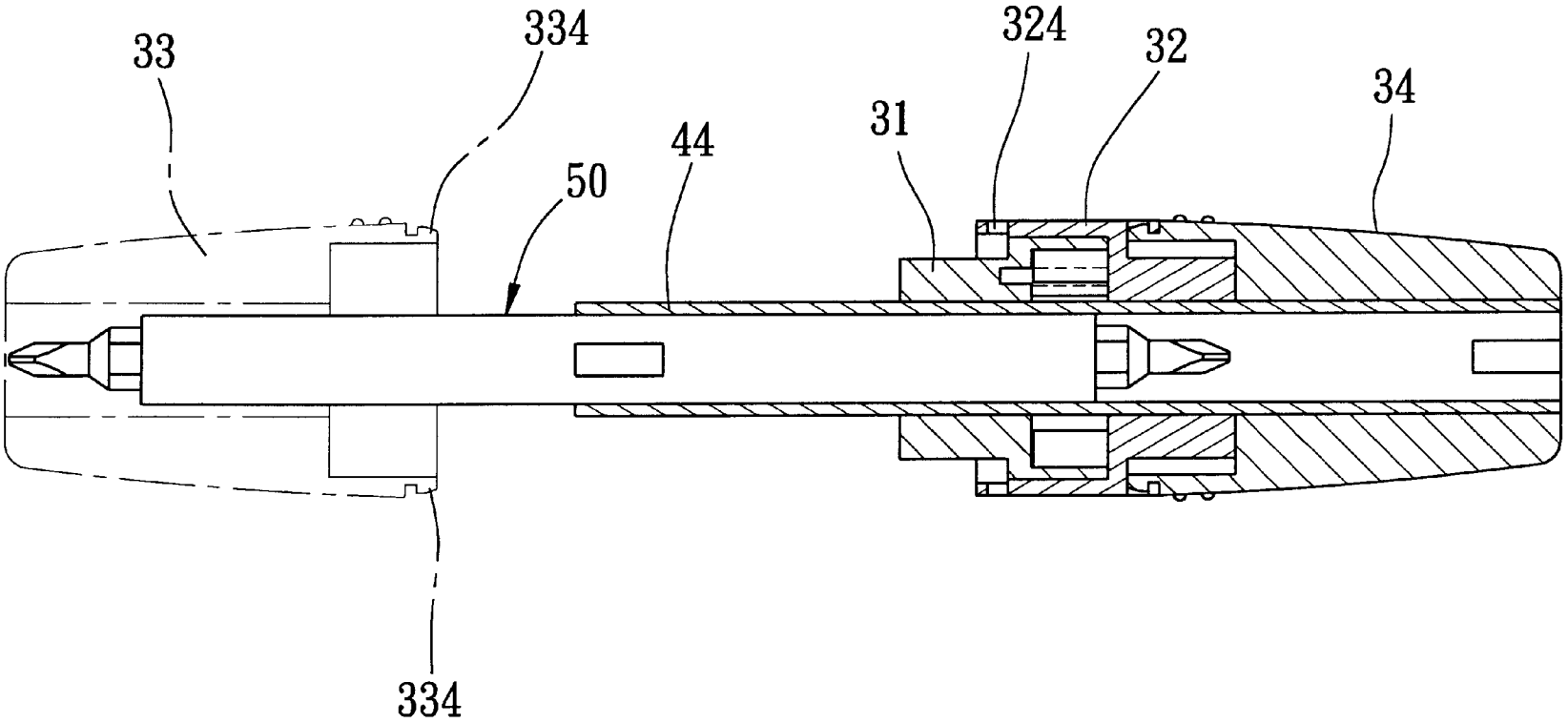
FIG. 8 illustrates how a part of the handle employed in the preferred embodiment is removed in a first way for lengthening the axial length of the drive shaft.
Figure 9:
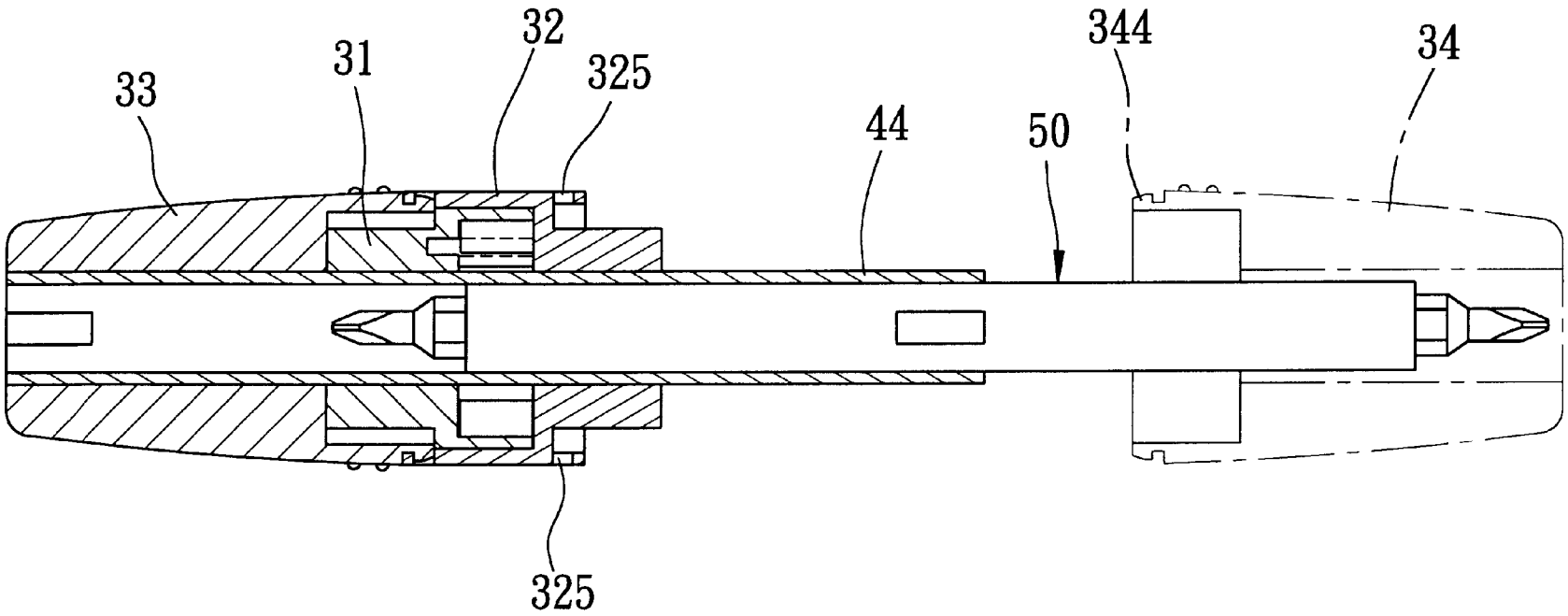
FIG. 9 illustrates how a part of the handle employed in the preferred embodiment is removed in a second way for lengthening the axial length of the drive shaft.

Referring to FIGS. 8 and 9, in the event that the drive shaft 50 must be extended into a deep hole for driving a workpiece, such as a screw, in the counterclockwise or clockwise direction and the initial length of the drive shaft 50 has to be lengthened, the front or rear part 33, 34 can be removed from the intermediate part 32 by pressing the resilient engaging tongues 334,344 radially and inwardly and then by moving the same away from the intermediate part along the axial direction.

Figure 10:
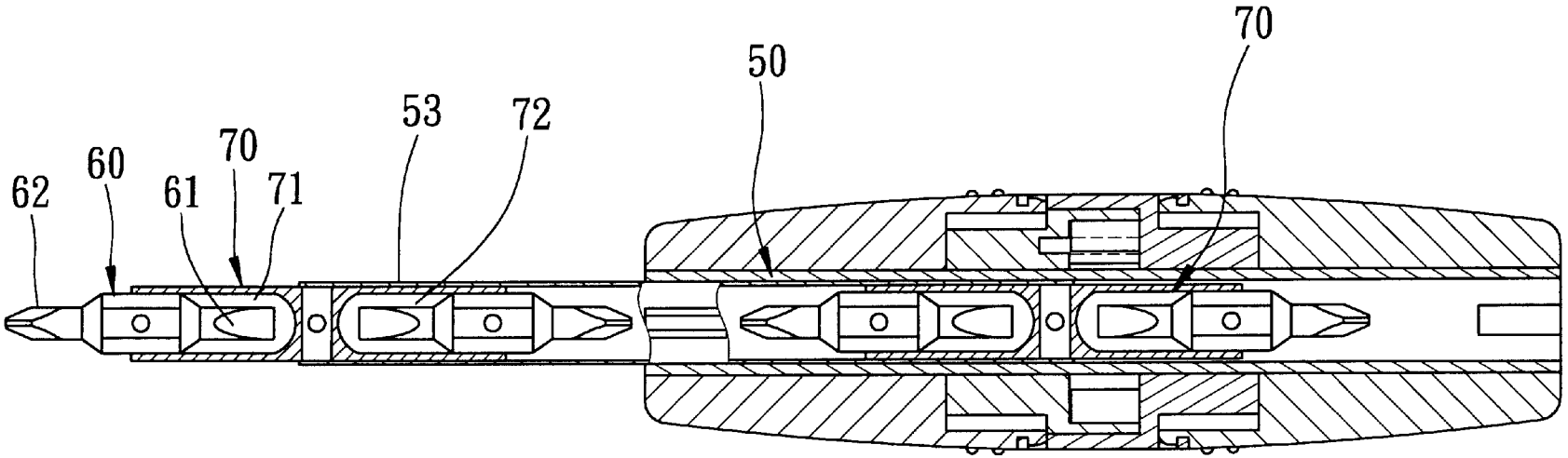
FIG. 10 is a sectional view of a modified preferred embodiment of the present invention.

Referring to FIG. 10, a modified preferred embodiment of the present invention is shown. The modified preferred embodiment is similar to the previous embodiment in structure, except that the drive shaft 50 further includes a pair of tool bit holding members 70 adapted to be received in the opposite ends of the cylindrical shaft portion 53 respectively, each of the tool bit holding members 70 having two opposite end portions 71,72 formed with bit engaging holes to receive two tool bits 60, respectively. As such, the modified preferred embodiment is adapted for work on eight types of workpieces.

While the present invention has been described in connection with what is considered the most practical and preferred embodiments, it is understood that the present invention is not limited to the disclosed embodiments but is intended to cover various arrangements included within the spirit and scope of the broadest interpretation so as to encompass all such modifications and equivalent arrangements.

I claim:

1. A ratchet screwdriver comprising:

a plurality of tool bits, each having an intermediate shank portion with a non-circular cross-section, and two bit portions at opposite ends of said shank portion and being designed to have different configurations for driving different types of workpieces;

an elongated handle having front and rear parts opposite to each other in an axial direction and a juncture therebetween which define a juncture line radial to said axial direction, said front and rear parts cooperating with each other to define a ratchet shaft receiving hole therethrough;

a drive shaft including a cylindrical shaft portion with two opposite ends, each of which is formed with an axially extending bit engaging hole of a non-circular cross-section to receive said intermediate shank portion of a respective one of said tool bits so as to expose said bit portion of said respective one of said tool bits outwardly of said bit engaging hole; and a ratchet assembly including a cylindrical ratchet shaft disposed rotatably in said ratchet shaft receiving hole, and having a circumferential wall with opposite first and second end portions to permit extension of said drive shaft, thereby exposing said bit engaging hole of said drive shaft outwardly of said handle when said drive shaft is removably inserted into said circumferential wall via said first end portion, and a ratchet wheel mounted securely and integrally thereon between said first and second end portions;

engaging means interposed between said ratchet shaft and said drive shaft for preventing axial displacement relative to each other and permitting co-rotation together;

a ratchet housing including a coupling portion with a first outer circumferential wall of non-circular cross-section and sleeved on said ratchet shaft and coupled with at least one of said front and rear parts so as to be co-rotatable axially therewith, a wheel confining portion extending from said coupling portion and defining a cavity enclosing said ratchet wheel therein, and a mounting shoulder between said coupling portion and said wheel confining portion and abutting against a front side of said ratchet wheel, said wheel confining portion further being formed with an axially extending pawl retaining groove in communication with said cavity, a pawl member disposed in said pawl retention groove, and having a pivot portion pivotally mounted on said mounting shoulder and an engaging portion extending integrally and radially from said pivot portion into said cavity, and a biasing member biasing said pawl member and urging said engaging portion to mesh constantly with said ratchet wheel such that when said handle is driven in a counterclockwise direction, said ratchet shaft and said drive shaft correspondingly rotate in said counterclockwise direction, whereby, when said handle has been turned around said juncture line by 180 degrees to have the positions of said front and rear parts reversed, and said drive shaft is removed from said first end portion and subsequently inserted into said second end portion of said ratchet shaft, rotation of said handle in a clockwise direction will reverse the drive direction of said drive shaft.

2. The ratchet screwdriver as defined in claim 1, wherein said handle further includes an intermediate part interposed between said front and rear parts, said intermediate part including a small-diameter section with a second outer circumferential wall of a non-circular cross-section which corresponds to said first outer circumferential wall of said coupling portion, a large-diameter section confining a first inner circumferential wall complementary with and sleeved on saidwheel confining portion of said ratchet housing, an abutment shoulder between said large and small-diameter sections and abutting against a rear side of said ratchet wheel, annular front and rear engaging portions disposed integrally at two opposite ends of said large-diameter section such that said front and rear engaging portions are diametrically spaced from said first and second outer circumferential walls, respectively, to define a front annular receiving space between said front engaging portion and first outer circumferential wall, and a rear annular receiving space between said rear engaging portion and said second outer circumferential wall, and two pairs of diametrically disposed engagement slots formed through said front and rear engaging portions, each of said front and rear parts further having a mating portion confining a second inner circumferential wall of a non-circular cross-section and corresponding to said first and second outer circumferential walls, and a spaced pair of resilient engaging tongues extending axially from said mating portion so as to be brought axially and coupled with said intermediate part with said engaging tongues engaging said engaging slots.

3. The ratchet screwdriver as defined in claim 2, wherein said engaging means includes an axially extending key projection disposed on said cylindrical shaft portion of said drive shaft and an axially extending projection engaging groove formed in at least one of said first and second end portion of said ratchet shaft to engage said key projection.

* * * * *